US005724928A

United States Patent [19]

Morii et al.

[11] Patent Number: 5,724,928

[45] Date of Patent: Mar. 10, 1998

[54] VALVE TIMING ADJUSTMENT DEVICE FOR INTERNAL COMBUSTION ENGINE

[75] Inventors: Yasushi Morii, Nagoya; Tomomasa Oonishi, Kariya; Michio Adachi, Obu, all of Japan

[73] Assignee: Denso Corporation, Kariya, Japan

[21] Appl. No.: 759,421

[22] Filed: Dec. 5, 1996

[30] Foreign Application Priority Data

Dec. 28, 1995 [JP] Japan ..... 7-342656

[51] Int. Cl.[6] ..... F01L 1/344

[52] U.S. Cl. ..... 123/90.17; 123/90.31; 464/2

[58] Field of Search ..... 123/90.15, 90.17, 123/90.31; 74/567, 568 R; 464/1, 2, 160

[56] References Cited

U.S. PATENT DOCUMENTS

| | | | |
|---|---|---|---|
| 4,811,698 | 3/1989 | Akasaka | 123/90.17 |
| 5,067,450 | 11/1991 | Kano et al. | 123/90.17 |
| 5,080,052 | 1/1992 | Hotta et al. | 123/90.17 |
| 5,090,365 | 2/1992 | Hotta et al. | 123/90.17 |
| 5,163,872 | 11/1992 | Niemiec et al. | 123/90.17 |
| 5,203,290 | 4/1993 | Tsuruta et al. | 123/90.17 |
| 5,215,046 | 6/1993 | Takenaka et al. | 123/90.17 |
| 5,377,639 | 1/1995 | Nakadouzono et al. | 123/90.17 |
| 5,426,992 | 6/1995 | Morii et al. | 74/409 |
| 5,535,705 | 7/1996 | Eguchi et al. | 123/90.17 |
| 5,592,909 | 1/1997 | Tsuruta | 123/90.17 |
| 5,592,910 | 1/1997 | Suga et al. | 123/90.17 |
| 5,605,121 | 2/1997 | Scheidt et al. | 123/90.17 |
| 5,657,671 | 8/1997 | Morii | 74/568 |

FOREIGN PATENT DOCUMENTS

| | | |
|---|---|---|
| 0 702 132 | 3/1996 | European Pat. Off. . |
| 5-77842 | 10/1993 | Japan . |
| U-6-28203 | 4/1994 | Japan . |
| A-7-305609 | 11/1995 | Japan . |
| 8-189313 | 7/1996 | Japan . |

*Primary Examiner*—Weilun Lo
*Attorney, Agent, or Firm*—Nixon & Vanderhye P.C.

[57] ABSTRACT

According to the present invention, in a valve timing adjustment device, an arc-shaped gears are assembled alternately on a piston in the peripheral direction. A spring biases an annular member and the arc-shaped gear in the direction as to be away from the piston. A pin is press-fitted into a retainer ring. A spring biases the arc-shaped gear toward the retainer ring, that is, in the direction as to be closer to the piston. An annular member, an annular groove, the head of the pin, a cap, and a containing hole function as a hydraulic damper, respectively. Accordingly, the collision speed of the annular member with the piston accompanied by the movement of the arc-shaped gears, and the piston and the collision speed of the head of the pin with the piston are slowed down. In this way, the respective collision noises can be reduced.

13 Claims, 4 Drawing Sheets

VALVE TIMING ADJUSTMENT DEVICE FOR INTERNAL COMBUSTION ENGINE

CROSS REFERENCE TO RELATED APPLICATION

This application is based on and claims priority of Japanese Patent Application No. Hei. 7-342656 filed on Dec. 28, 1995, the content of which is incorporated herein by reference.

BACKGROUND OF THE INVENTION

1. Field of the Invention

The present invention relates to a valve timing adjustment device for an internal combustion engine, which transmits a torque from a driving side rotating body to a driven side rotating body while changing rotational phases of both the rotating bodies.

2. Description of Related Art

In a conventional valve timing adjustment device for an internal combustion engine, a driving power is transmitted from a crankshaft of the internal combustion engine to a timing pulley as a driving side rotating body by, for example, a timing belt. A ring-shaped gear as a transmitting member is placed between the timing pulley and a cam shaft as a driven side rotating body to transmit a rotary driving power of the timing pulley from the ring-shaped gear to the cam shaft. The ring-shaped gear is engaged with the timing pulley and the spline of the cam shaft, where at least one of those timing pulley and the spline of the cam shaft is engaged with a helical spline. The cam shaft and the timing pulley relatively rotate by moving the ring-shaped gear in the axial direction for adjusting valve timing of either one of or both an air intake valve and an exhaust valve according to operation conditions of the internal combustion engine. Such a valve timing adjustment device is disclosed in JP-B2-5-77842 and is well known.

As for the valve timing adjustment device disclosed in the JP-B2-5-77842, a gear connected to plural gear-composing bodies whose tooth traces are slightly staggered by an elastic member is fixed between the timing pulley and the cam shaft. This gear is divided into plural gear-composing bodies at a planar surface crossing a shaft and the gear composing-bodies are connected by an elastic member or the like. Pressure is imposed on one gear-composing member in one direction with respect to the other gear-composing body for reducing a tooth noise due to back lash.

However, in the device disclosed in the conventional JP-B2-5-77842, since a pressure-receiving piston is disposed at one end in the axial direction of the plural gear-composing bodies and transmits hydraulic pressure applied from a hydraulic pump to the gear, the gear is moved in the axial direction due to torque change generated by opening or closing of a valve with the cam shaft, and it may cause a noise due to a collision of the pressure-receiving piston with the gear. Such an abnormal noise is especially caused when the position of the pressure-receiving piston is controlled independently by hydraulic pressure imposed on the both sides of the pressure-receiving piston.

SUMMARY OF THE INVENTION

In view of the above noted problem, an object of the present invention is to provide a valve timing adjustment device for an internal combustion engine, which can reduce collision noise.

According to the present invention, in a valve timing adjustment device for an internal combustion engine where a driving side rotating body and a driven side rotating body are relatively rotated, damping means is disposed between a transmitting member for rotating the driving side rotating body relatively to the driven side rotating body and a moving body for transmitting a driving force to the transmitting member. In this way, collision noise of a transmitting member with a moving body can be reduced.

Further, the transmitting member may be made of plural divided bodies and these divided bodies are biased in a reverse direction. In this way, collision noise at the connecting portions between the transmitting member and a driving side rotating body and between the transmitting member and the driven side rotating body can be prevented.

Still further, the damping means may be a hydraulic damper including a piston portion and a cylinder portion for reciprocatingly movably supporting the piston portion. Oil for driving the transmitting member may be utilized as damping means, and therefore, the damping means can be easily constructed.

Further, the transmitting member may be made of plural divided bodies divided at a divided surface along a shaft, and the annular member contacts with at least more than two of the divided bodies. In this way, each divided transmitting member can be equally imposed by biasing the divided transmitting member via an annular member Still further, the damping means may be an elastic body. In this way, the collision between the transmitting member and the moving body can be softened with a few parts by utilizing an elastic member.

BRIEF DESCRIPTION OF THE DRAWINGS

Additional objects and advantages of the present invention will be more readily apparent from the following detailed description of preferred embodiments thereof taken together with the accompanying drawings in which.

DETAILED DESCRIPTION OF THE PREFERRED EMBODIMENTS

Embodiments according to the present invention are hereinafter described with reference to the accompanying drawings.

A first embodiment of the present invention will be described.

FIGS. 1–5 show a valve timing adjustment device for an internal combustion engine according the first embodiment of the present invention.

Figure 3:
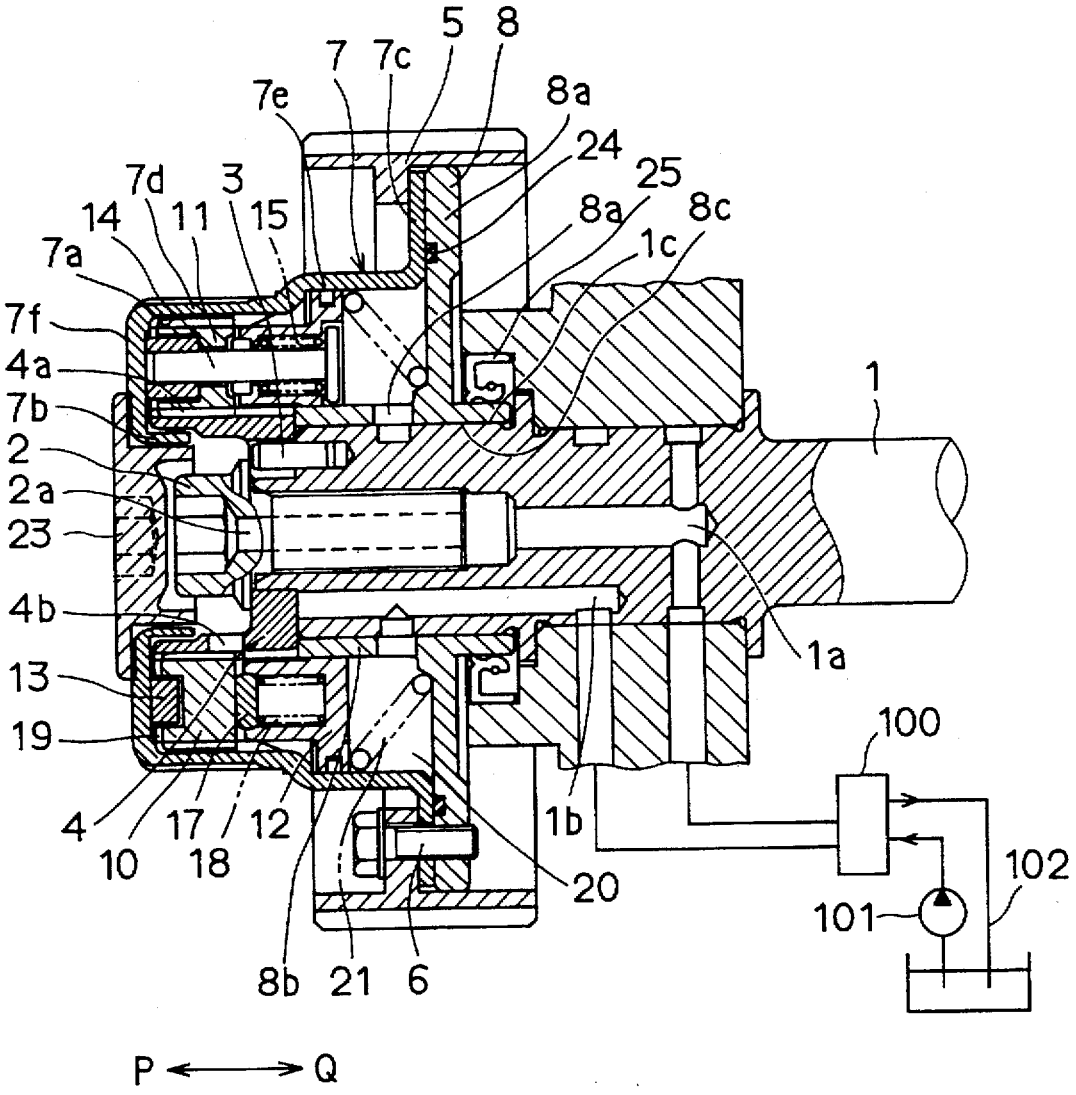
FIG. 3 is a longitudinal cross-sectional view showing a valve timing adjustment device according to the first embodiment of present invention.

In FIG. 3, a rotary torque from a crank shaft (not shown) is transmitted to a timing pulley 5 as a driving side rotating body via a timing belt (not shown) in FIG. 3.

A cylindrical cam shaft sleeve 4 is fixed at one end of a cam shaft 1 by way of a bolt 2 and a pin 3 so as to rotate the cam shaft sleeve 4 integrally with the cam shaft 1 as a driven side rotating body. An outer tooth helical spline 4*a* is formed at a portion of the outer peripheral wall of the cam shaft sleeve 4.

A sprocket sleeve 7 is integrally formed of an outer cylinder having a smaller diameter portion 7*d* and a larger diameter portion 7*e*, a toroidal-shaped flange 7*c* extending from the opposite side to the smaller diameter portion of the larger diameter portion 7*e* to the outside in the diameter direction, an inner cylinder 7*b*, and a toroidal portion 7*f* connecting the outer cylinder extending to the inside in the diameter direction from the opposite side to the larger diameter of the smaller diameter portion 7*d* to the inner cylinder 7*b*. An inner tooth helical spline 7*a* is formed at a portion of the inner peripheral wall of the smaller diameter portion 7*d*. The inner tooth helical spline 7*a* is formed to have a torsional angle reverse to the outer tooth helical spline 4*a* of the cam shaft sleeve 4. One of the outer tooth helical spline 4*a* and the inner helical spine 7*a* may be formed as a linear spline in parallel with the axial direction with zero torsional angle.

A flange member 8 is integrally formed of a toroidal portion 8*a* extending in the diameter direction of the cam shaft 1 and a cylindrical portion 8*b*.

The toroidal portion 8*a* of the flange member 8 and the flange 7*c* of the sprocket sleeve 7 is fixed to the timing pulley 5 with a bolt 6. Since the inner side surface 8*c* of the cylindrical portion 8*b* of the flange member 8 is supported by the outer peripheral wall 1*c* of the cam shaft 1, the timing pulley 5 is relatively and rotatably supported by the cam shaft 1.

Figure 1:
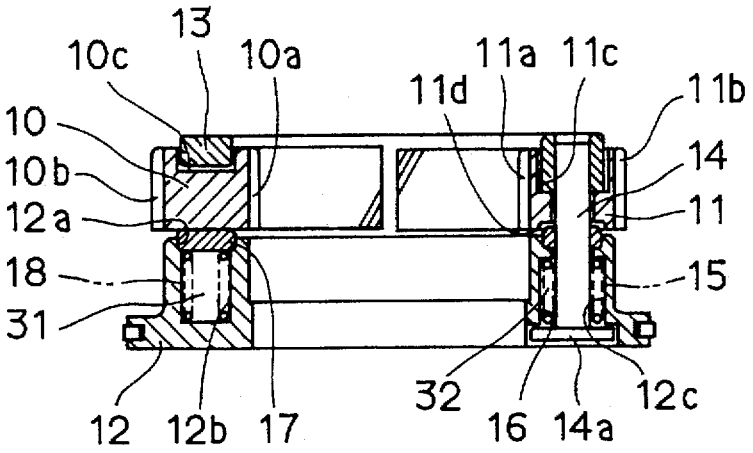
FIG. 1 is a cross-sectional view taken along the line I-b-c-d-e-I of FIG. 2 showing a transmitting member and a moving body according to a first embodiment of the present invention.
Figure 2:
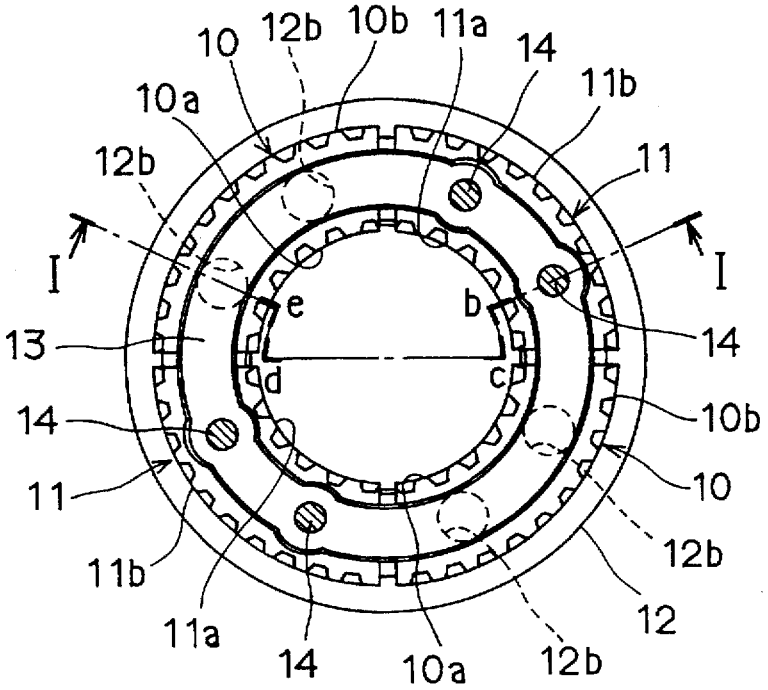
FIG. 2 is a plan view showing the transmitting member and the moving body according to the first embodiment.

Two arc-shaped gears 10 and 11 for relatively rotating the timing pulley 5 and the cam shaft 1 are respectively placed between the cam shaft sleeve 4 and the sprocket sleeve 7 in the radial direction. The arc-shaped gears 10 and 11 are formed by dividing one ring-shaped gear as a transmitting member at its divided surface including the shaft and are divided bodies of the transmitting member. When the arc-shaped gears 10 and 11 move in the arrow mark P direction in FIG. 3, the cam shaft 1 lags with respect to the timing pulley 5, on the other hand, when these gears 10 and 11 move in the arrow mark Q direction, the cam shaft 1 advances with respect to the timing pulley 5. As shown in FIGS. 1 and 2, the arc-shaped gears 10 and 11 are alternately installed on a piston 12 as a moving body in the peripheral direction, however, these gears 10 and 11 look like one ring-shaped gear in its appearance. FIG. 1 shows a state of the arc-shaped gears 10 and 11, and the piston 12 placed between the cam shaft sleeve 4 and the sprocket sleeve 7. Arc-shaped grooves 10*c* and 11*c* containing retainer rings 13 are formed at the top of the arc-shaped gears 10 and 11. In the state shown in FIG. 1, the retainer ring 13 does not contact with the arc-shaped gear 10 in the axial direction. The periphery of the arc-shaped gears 10 and 11, and the piston 12 is filled with oil. An annular groove 12*a* and containing holes 12*b* and 12*c*, described later, are also filled with oil.

The annular groove 12*a* as a cylinder portion is formed at each side of the arc-shaped gears 10 and 11 of the piston 12, and an annular member 17 fits into this annular groove 12*a*. Since the piston side of the arc-shaped gear 11 has an arc-shaped concave groove 11*d*, the annular member 17 and the arc-shaped gear 11 do not contact with each other in the axial direction in the state shown in FIG. 1. The annular groove 12*a* has the containing hole 12*b* with a bottom for containing a spring 18 and the containing hole 12*c* without a bottom, into which a pin 14 is inserted.

Figure 4:
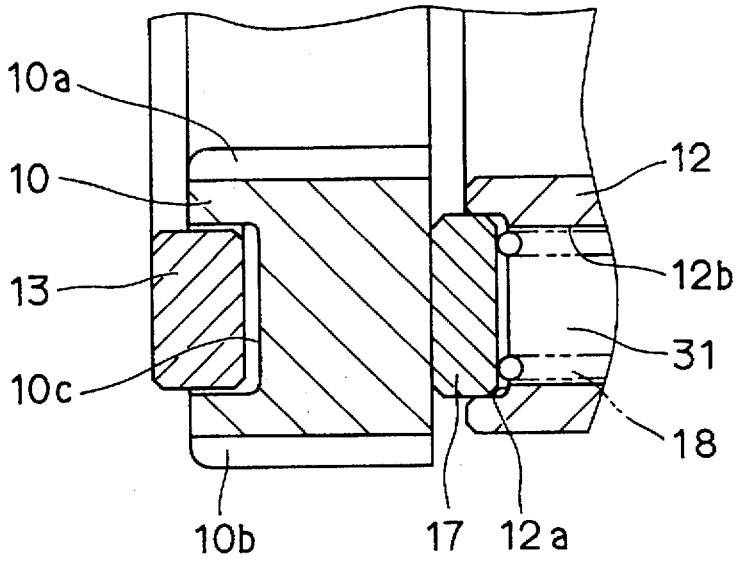
FIG. 4 is an enlarged cross-sectional view showing a hydraulic damper according to the first embodiment.

The spring 18 is contained in the containing hole 12*b* formed at a position corresponding to the arc-shaped gear 10 in the axial direction and biases the annular member 17 and the arc-shaped gear 10 in the direction as to be away from the piston 12. The oil inside a hydraulic chamber 31 formed by the annular groove 12*a*, the containing hole 12*b*, and the annular member 17 is substantially liquidtightly sealed by the annular member 17 as shown in FIG. 4. Because the groove 12*a* and the annular member 17 constitute a hydraulic damper, the speed of the arc-shaped gear 10 together with the annular member 17, which approaches the piston 12, is slowed down.

Figure 5:
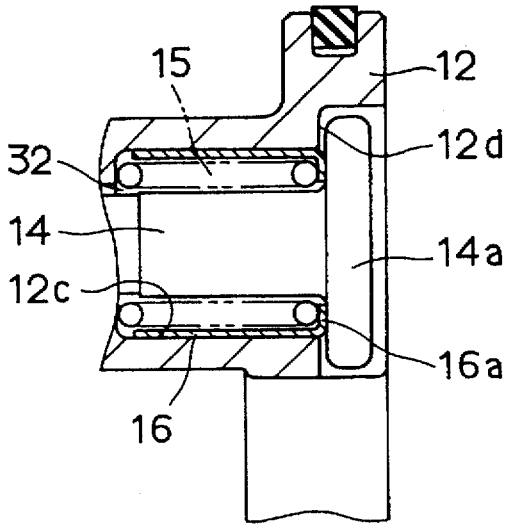
FIG. 5 is an enlarged cross-sectional view showing another hydraulic damper according to the first embodiment.

The pin 14 is reciprocatingly movably inserted into the piston 12 and the arc-shaped gear 11 and also slidably inserted into the annular member 17. Since the pin 14 is press-fitted into the retainer ring 13, the retainer ring 13 and the pin 14 move together. The retainer ring 13 and the pin 14 constitute a part of a transmitting member. A cylindrical cap 16 is contained in the containing hole 12*c* and the pin 14 is fittingly inserted into the inner periphery of the cap 16 as shown in FIG. 5. The cap 16 has an annular engaging portion 16*a* at the head 14*a* of the pin 14. This engaging portion 16*a* and the head 14*a* contact with each other by a biasing force of the spring 15. The cap 16 and the head 14*a* constitute a cylindrical member with a bottom. Accordingly, both the cap 16 and the pin 14 are biased toward the right side in FIG. 5, so that the retainer ring 13 and the arc-shaped gear 11 are biased toward the right side in FIG. 3, that is, are biased in the direction closer to the piston 12 which is an opposite direction to the biasing direction of the arc-shaped gear 10 by the spring 18. A hydraulic chamber 32 formed by the annular member 17, the annular groove 12*a*, the containing hole 12*c*, the cap 16, and the head 14*a* is substantially liquidtightly sealed. The cap 16 as a cylindrical member having a bottom and the head 14*a*, and the containing hole 12*c* compose the hydraulic damper, so that the speed when the head 14*a* of the pin 14 approaches the piston 12 is slowed down.

The inner tooth helical splines 10*a* and 11*a* are formed on the inner peripheral walls of the arc-shaped gears 10 and 11 as shown in FIGS. 1 and 2 whereas the outer tooth helical splines 10*b* and 11*b* are formed on the outer peripheral walls thereof. The arc-shaped gears 10 and 11 can move in the axial direction in the compression range of the respective springs 18 and 15. Since the arc-shaped gears 10 and 11 are biased in a direction as to be away from each other, the positions in the axial direction of the outer tooth helical splines 10*b* and 11*b* and the inner tooth helical splines 10*a* and 11*a* are further deviated from the positions shown in FIG. 1 in the state before the arc-shaped gears 10 and 11 are placed between the sprocket sleeve 7 and the cam shaft sleeve 4.

When the arc-shaped gears 10 and 11 are placed between the sprocket sleeve 7 and the cam shaft sleeve 4, the arc-shaped gears 10 and 11 move slightly in the axial as well as rotational directions of the cam shaft 1 by the distance to absorb the back lash between the splines. That is, the arc-shaped gears 10 and 11 are placed between the sprocket sleeve 7 and the camshaft sleeve 4 by making the deviation in the axial direction smaller than the state before being placed. The spring 18 and the spring 15 bias the respective arc-shaped gears 10 and 11 in the reverse direction to the axial direction with respect to the piston 12. The biasing force gives torque to the arc-shaped gear 10 so that the arc-shaped gear 10 relatively rotates the cam shaft 1 in the lag direction with respect to the timing pulley 5 whereas the arc-shaped gear 11 relatively rotates the cam shaft 1 in the advance direction with respect to the cam shaft 1. In other words, depending on the biasing force of the spring 18, the outer tooth helical spline 10*b* of the arc-shaped gear 10 presses the inner tooth helical spline 7*a* of the sprocket sleeve 7 in the lag direction whereas the inner tooth helical spline 10*a* presses the outer tooth helical spline 4*a* of the cam shaft sleeve 4 in the lag direction. On the other hand, depending on the biasing force of the spring 15, the outer tooth helical spline 11*b* of the arc-shaped gear 11 presses the inner tooth helical spline 7*a* of the sprocket sleeve 7 in the advance direction whereas the inner tooth helical spline 11*a* presses the outer tooth helical spline 4*a* of the cam shaft sleeve 4 in the advance direction. Therefore, the arc-shaped gears 10 and 11 are supplied with a torque resisting positive or negative fluctuating torque of the cam shaft 1 by the biasing force of the respective springs 18 and 15, which can suppress a tooth noise caused by the back lash between the splines.

Such engagement of the splines transmits the rotation of the timing pulley 5 to the cam shaft 1 via the sprocket sleeve 7, the arc-shaped gears 10 and 11, and the cam shaft sleeve 4.

An advance side hydraulic chamber 19 is formed at the left side of the arc-shaped gears 10 and 11 between the cam shaft sleeve 4 and the sprocket sleeve 7 while a lag side hydraulic chamber 20 is formed at the right side of the piston 12, in FIG. 3. The advance side hydraulic chamber 19 and the lag side hydraulic chamber 20 are to be liquid tight sealed by an O-ring 24 placed between a bolt 23 and the flange member 8. Furthermore, it is substantially sealed to be liquid tight by the cylindrical portion 8*b* of the flange member 8. An oil seal 25 prevents the hydraulic oil having leaked from the cylindrical portion 8*b* from leaking outside the device.

A spring 21 for biasing the piston 12 to the lag side is disposed in the lag side hydraulic chamber 20. In the state that operating hydraulic pressure is not applied to the advance side hydraulic chamber 19 and the lag side hydraulic chamber 20 before starting the internal combustion engine, the arc-shaped gears 10 and 11 are located at the most lag side by way of the biasing force of this spring 21. Until the operation hydraulic pressure reaches a predetermined value after starting the internal combustion engine, the movement of the arc-shaped gears 10 and 11 are restricted.

The supply of pressured oil to oil passages communicating with the advance side hydraulic chamber 19 and the lag side hydraulic chamber 20 and the discharge of the pressured oil from the oil passages are controlled by switching a hydraulic control valve 100. More specifically, an oil passage 4*b* formed in the cam shaft sleeve 4 communicating with the advance side hydraulic chamber 19, an oil passage 2*a* formed in the bolt 2, an oil passage 1*a* formed in the cam shaft 1, an oil pump 101 and a drain 102 are communicated with each other or shut off by switching the hydraulic control valve 100 to control the hydraulic pressure inside the advance side hydraulic chamber 19. On the other hand, an oil passage 8*d* formed in the flange member 8 communicating with the lag side hydraulic chamber 20, an oil passage 1*b* formed in the cam shaft 1, the oil pump 101 and the drain 102 are communicated with each other or shut off by switching the hydraulic control valve 100 to control the hydraulic pressure inside the lag side hydraulic chamber 20. The arc-shaped gears 10 and 11 and the piston 12 are moved or stopped in accordance with the balance of the hydraulic pressures in the advance side hydraulic chamber 19 and the lag side hydraulic chamber 20 to control a phase difference of the cam shaft 1 with respect to the timing pulley 5.

In this embodiment, driving means includes the piston 12 as a moving body, the advance side hydraulic chamber 19 formed at the both sides of the piston, the lag side hydraulic chamber 20, the hydraulic pressure control valve 100 as a hydraulic pressure control means, the oil pump 101, and the drain 102.

An operation of the hydraulic damper as damping means in this embodiment will be hereinafter described.

According to this embodiment, the position of the piston 12 in the axial direction in the cylinder is controlled by the hydraulic pressure in the advance hydraulic chamber 19 and the lag hydraulic chamber 20 and the hydraulic pressure is imposed on the both sides of the piston 12 to regulate the position of the piston 12. The positions of the arc-shaped gears 10 and 11 connected to the piston 12 are controlled by the position corresponding to the position of the piston 12 in the axial direction. Therefore, the piston 12 moves in the axial direction by controlling the hydraulic pressures in the advance side hydraulic chamber 19 and the lag side hydraulic chamber 20 with the movement of the arc-shaped gears 10 and 11 in the axial direction by the piston 12.

When the cam shaft 1 opens or closes at least one of an air intake valve and an exhaust valve, positive or negative torque fluctuation generates in the rotational direction. This fluctuating torque appears as a minute positional change in the axial direction of the arc-shaped gears 10 and 11 connected to the cam shaft sleeve 4 with the helical spline. At that time, the position of the piston 12 is restricted by the hydraulic pressure in the both hydraulic chambers, so that the arc-shaped gears 10 and 11 are going to collide indirectly with the piston 12 or the pin 14 via the annular member 17 or the pin 14. The following cases of (1) and (2) are expected as a positional change in the colliding direction. In both cases, in this embodiment, any collisions which causes a noise can be avoided by the hydraulic damper as damping means.

(1) When the arc-shaped gear 10 and the piston 12 approach closer and the annular member 17 and the piston 12 are going to collide, since the colliding speed is slowed down by the hydraulic damper constituted by the annular groove 12*a* and the annular member 17 disposed at the position corresponding to the arc-shaped gear 10, a collision noise is lowered. Even if the arc-shaped gear 11 approaches the piston 12, the arc-shaped gear 11 does not push the annular member 17 toward the piston side because the arc-shaped gear 11 and the annular member 17 do not contact with each other in the axial direction by way of the concave groove 11*d* formed in the arc-shaped gear 11.

(2) When the arc-shaped gear 11 and the piston 1 are away from each other and the head 14*a* of the pin 14 is going to collide with the piston 12, since the colliding speed is slowed down by the hydraulic damper constituted by the containing hole 12*c*, the cap 16 and the head 14*a* of the pin 14, a collision noise is lowered.

According to the aforementioned first embodiment, because the arc-shaped gears 10 and 11 are biased in the reverse direction of the shaft and in the direction as to be away from each other via the piston 12 by the biasing force of the springs 18 and 15, the outer tooth helical splines 10*b* and 11*b* give torque in the reverse direction to the inner tooth helical spline 7*a* respectively at the sprocket sleeve 7 side so as to contact therewith, whereas the inner tooth helical splines 10*a* and 11*a* give torque in the reverse direction to the outer tooth helical spline 4*a* at the cam shaft sleeve 4 side so as to contact therewith. In this way, even if torque varies against the reverse side to the rotation direction (positive torque) or to the same direction as the rotation direction (negative torque) due to fluctuating torque in the rotational direction of the cam shaft 1, a tooth noise by way of the back lash of the helical splines can be suppressed.

Furthermore, because the annular member 17, the annular groove 12*a*, the cap 16, the head 14*a* of the pin 14, and the containing hole 12*b* serve as hydraulic dampers respectively, the collision of the arc-shaped gears 10 and 11 with respect to the piston 12 can be softened. Therefore, a collision noise can be reduced.

Figure 6:
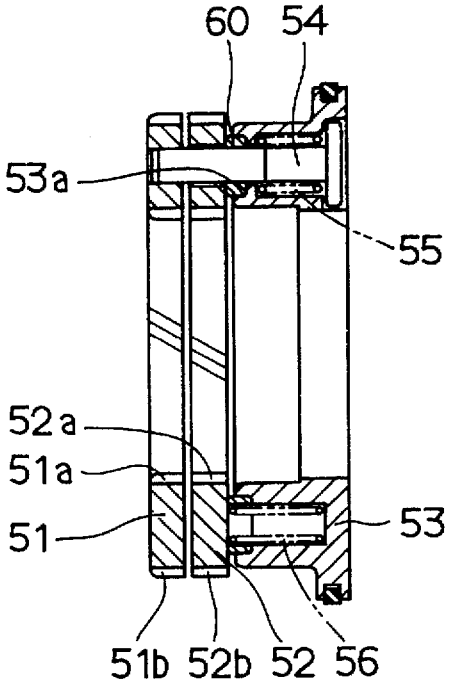
FIG. 6 is a longitudinal cross-sectional view showing a valve timing adjustment device according to a second embodiment of the present invention.

A second embodiment of the present invention will be described with reference to FIG. 6.

A transmitting member is composed of a first ring-shaped gear 51, a second rig-shaped gear 52, and a pin 54. The first ring-shaped gear 51 and the second ring-shaped gear 52 are formed by dividing one ring-shaped gear as the transmitting member into two at the divided surface which is perpendicular to the axial direction and form divided bodies of the transmitting member. The inner tooth helical splines 51*a* and 52*a* are formed on the inner peripheral walls of the first ring-shaped gear 51 and the second ring-shaped gear 52 whereas the outer tooth helical splines 51*b* and 52*b* are formed on the outer peripheral walls. A piston 53 as a moving body, the second ring-shaped gear 52, and the first ring-shaped gear 51 are disposed in the axial direction in this order. An annular groove 53*a* is formed at the second ring-shaped gear 52 side of the piston 53, and an annular rubber damper 60 as an elastic body fits into this annular groove 53*a*.

A pin 54 passes through the rubber damper 60 and is press-fitted into the first ring-shaped gear 51. A spring 55 biases the pin 54 in the right direction in FIG. 6, and the first ring-shaped gear 51 is biased in the direction as to be closer to the piston 53. A spring 56 passes through the rubber damper 60 and biases the second ring-shaped gear 52 in the direction as to be away from the piston 53.

Accordingly, the first ring-shaped gear 51 and the second ring-shaped gear 52 are biased in the reverse direction as to be closer to each other by the springs 55 and 56. The tooth trances of the first ring-shaped gear 51 and the second ring-shaped gear 52 are most deviated from each other before assembled, however, the deviation of the tooth trances is reduced by placing the gears between a sprocket sleeve and a cam shaft sleeve (not shown) in FIG. 6, so that the first ring-shaped gear 51 and the second ring-shaped gear 52 are separated from each other and are engaged with the sprocket sleeve and the helical spline tooth of the cam shaft sleeve. In this way, a tooth noise due to the back lash between the splines can be reduced.

By providing the rubber damper 60 between the second ring-shaped gear 52 and the piston 53, the collision of the second ring-shaped gear 52 with the piston 53 can be softened, and a collision noise can be reduced. A rubber damper as an elastic body can be placed between the head of the pin 54 and the piston 53.

According to the aforementioned second embodiment of the present invention, divided bodies of the transmitting member are biased in the direction as to be closer to each other or in the reverse direction to be separated from each other, however, the biasing direction of the divided bodies can be any direction if it is relatively reverse direction with respect to the piston. Furthermore, a spring may be placed between the divided bodies as shown in the prior art to bias the divided bodies in the reverse direction.

According to the second embodiment of the present invention, both the inner and the outer splines of the ring-shaped gears are helical splines, however, one of the inner or the outer spline of the ring-shaped gears may be a helical spline in the present invention.

The spline connection may be structured of a simple protrusion engaged with a tooth groove between the spline teeth. If the spline tooth and the protrusion are formed either on the inner periphery or outer periphery, such a spline connection can be obtained. The same can be applied to connections using helical splines. In this case, a helical spline tooth and a protrusion can be formed either on the inner periphery or the outer periphery. Instead of a helical spline, at least one of connections between a driving side rotating body and a transmitting member and between a driven side rotating body and the transmitting member may be structured by utilizing a wedge-shaped inclined surface.

Although the present embodiment transmits the driving power of the crankshaft to the timing pulley 5 via a timing belt, transmission is not limited to such a timing belt method. The driving power of the crankshaft may be transmitted to a timing pulley as a driving side rotating body by chain driving or gear driving. In this case, the driving side rotating body is called a sprocket or a final stage gear. The valve timing adjustment device may be disposed aligned with the crankshaft or even at the midway of the crankshaft.

As described above, a driving side rotating body is connected to a driven side rotating body via a transmitting member. In addition, at least one of the connections between the driving side rotating body and the transmitting member and between the driven side rotating body and the transmitting member is structured of an engagement mechanism including an inclined surface with respect to the axial direction as well as the rotational direction (such as a helical spline or a wedge-shaped inclined surface). It is to be noted that the positions in the rotational direction of the driving side rotating body changes relatively to that of the driven side rotating body in accordance with the movement of the transmitting member in the axial direction.

It is also to be noted that not only the transmitting member is divided into plural divided bodies and the respective divided bodies are placed between the both rotating bodies enabling to transmit power but also back lash at the connecting portion of the transmitting member and the both rotating bodies is absorbed by biasing the divided bodies in the reverse direction from each other. However, the shape of the divided bodies of the transmitting member may be formed by dividing a cylindrical transmitting member at a planar surface including a shaft or by dividing at a planar surface perpendicular to the shaft. As for biasing between the divided bodies, a spring may be placed between the divided bodies or the respective divided bodies may be biased in the different direction as a standard from the piston based on the piston as a separate moving body from the transmitting member.

It is to be noted that damping means is placed between the transmitting member and the moving body to soften the to collision due to positional change of the transmitting member. The damping means is desirably placed between all the divided bodies constituting the transmitting member and the moving body, however, it can be placed only at the portion which generates a especially loud collision noise. Furthermore, the damping means may be directly placed between the transmitting member and the moving body or placed indirectly via some member. The collision of the transmitting member with the moving body includes not only the direct collision therebetween but also an indirect collision via the pins 14 and 54 as connecting members for connecting the transmitting member to the moving body or via the retainer ring 13 as a connecting member for connecting plural divided bodies and the annular member 17. For that purpose, the damping means may be placed indirectly between the transmitting member and the moving body via these pins 14 and 54 or the retainer ring 13 and the annular member 17. As the damping means, a hydraulic damper utilizing hydraulic pressure or a rubber damper using an elastic member can be employed. In case plural divided bodies are biased by biasing means such as a spring to absorb back lash based on the piston as the moving body, a biasing means for absorbing back lash can also function as the damping means. However, the damping means is desirably disposed separately from the biasing means for absorbing back lash to satisfy to obtain biasing force suitable for absorbing back lash and to obtain preferable damping performance.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A valve timing adjustment device for an internal combustion engine, said valve timing adjustment device rotating a driving side rotating body relative to a driven side rotating body, said valve timing adjustment device comprising:

a transmitting member disposed between a driving side rotating body and a driven side rotating body, for rotating said driving side rotating body relative to said driven side rotating body by moving in an axial direction;

driving means formed separately from said transmitting member and including a moving body for transmitting driving power to said transmitting member, said moving body being moved in the axial direction; and damping means disposed between said transmitting member and said moving body wherein said damping means is a hydraulic damper including a piston portion and a cylinder portion for reciprocatingly movably supposing said piston portion.

2. A valve timing adjustment device as set forth in claim 1, wherein said transmitting member is made of plural divided bodies and these divided bodies are biased away from each other.

3. A valve timing adjustment device as set forth in claim 1, wherein said transmitting member includes gears which engage with each other by way of helical splines.

4. A valve timing adjustment device as set forth in claim 1, wherein said damping means includes an elastic body.

5. A valve timing adjustment device as set forth in claim 1, wherein said hydraulic damper has an annular groove and an annular member fitted into said annular groove.

6. A valve timing adjustment device as set forth in claim 1, wherein said hydraulic damper includes a cylindrical member with a bottom and a containing hole containing said cylindrical member with the bottom.

7. A valve timing adjustment device as set forth in claim 5, wherein said transmitting member is made of plural divided bodies divided at a divided surface along a shaft; and said annular member contacts with at least three of said divided bodies.

8. A valve timing adjustment device as set forth in claim 1, wherein said driving side rotating body is a timing pulley driven by a crankshaft of said engine.

9. A valve timing adjustment device as set forth in claim 8, wherein said driven side rotating body is a camshaft for operating an intake valve or an exhaust valve for said engine.

10. A valve timing adjustment device for an internal combustion engine, said valve timing adjustment device rotating a driving side rotating body relative to a driven side rotating body, said valve timing adjustment device comprising:

a transmitting member disposed between a driving side rotating body and a driven side rotating body, for rotating said driving side rotating body relative to said driven side rotating body by moving in an axial direction;

a moving body for transmitting a driving power to said transmitting member;

driving means formed separately from said transmitting member, for moving said moving body in the axial direction; and damping means disposed between said transmitting member and said moving body wherein said damping means is a hydraulic damper including a piston portion and a cylinder portion for reciprocatingly movably supposing said piston portion.

11. A valve timing adjustment device for an internal combustion engine, said valve timing adjustment device rotating a driving side rotating body relative to a driven side rotating body, said valve timing adjustment device comprising:

a transmitting member disposed between a driving side rotating body and a driven side rotating body, for rotating said driving side rotating body relative to said driven side rotating body by moving in an axial direction;

a driving device formed separately from said transmitting member and including a moving body for transmitting driving power to said transmitting member, said moving body being moved in the axial direction; and a damping device disposed between said transmitting member and said moving body wherein said damping device is a hydraulic damper including a piston portion and a cylinder portion for reciprocatingly movably supporting said piston portion.

12. A valve timing adjustment device as set forth in claim 11, wherein said hydraulic damper has an annular groove and an annular member fitted into said annular groove.

13. A valve timing adjustment device as set forth in claim 11, wherein said hydraulic damper includes a cylindrical member with a bottom and a containing hole containing said cylindrical member with the bottom.

* * * * *